US007194067B2

(12) United States Patent
Van den Hoogenhof et al.

(10) Patent No.: US 7,194,067 B2
(45) Date of Patent: Mar. 20, 2007

(54) X-RAY OPTICAL SYSTEM

(75) Inventors: Waltherus W. Van den Hoogenhof, Almelo (NL); Hendrik A. Van Sprang, Almelo (NL)

(73) Assignee: Panalytical B.V. (NL)

( * ) Notice: Subject to any disclaimer, the term of this patent is extended or adjusted under 35 U.S.C. 154(b) by 14 days.

(21) Appl. No.: 10/479,498

(22) PCT Filed: May 30, 2002

(86) PCT No.: PCT/IB02/01965

§ 371 (c)(1),
(2), (4) Date: Jul. 13, 2004

(87) PCT Pub. No.: WO02/097826

PCT Pub. Date: Dec. 5, 2002

(65) Prior Publication Data

US 2004/0240620 A1 Dec. 2, 2004

(30) Foreign Application Priority Data

Jun. 1, 2001 (EP) ..... 01202113

(51) Int. Cl.
*G21K 1/02* (2006.01)

(52) U.S. Cl. ..... 378/147

(58) Field of Classification Search ..... 378/147, 378/148, 149, 150, 151, 152, 153
See application file for complete search history.

(56) References Cited

U.S. PATENT DOCUMENTS 2,558,492 A * 6/1951 Van Rijssel et al. ..... 378/70
4,809,314 A * 2/1989 Steele et al. ..... 378/205
5,682,415 A * 10/1997 O'Hara ..... 378/147

* cited by examiner

*Primary Examiner*—Edward J. Glick
*Assistant Examiner*—Chih-Cheng Glen Kao
(74) *Attorney, Agent, or Firm*—Blakely Sokoloff Taylor & Zafman

(57) ABSTRACT

An X-ray optical diaphragm (3; 4) which is provided with at least one passage opening (3*a;* 4*a*) for rays is constructed in such a manner that the edge zone (9; 10) of the X-ray optical diaphragm (3; 4) which faces the passage opening (3*a;* 4*a*) is angulated at least partly relative to the direction of propagation (7) of the rays.

8 Claims, 3 Drawing Sheets

X-RAY OPTICAL SYSTEM

Figure 1:
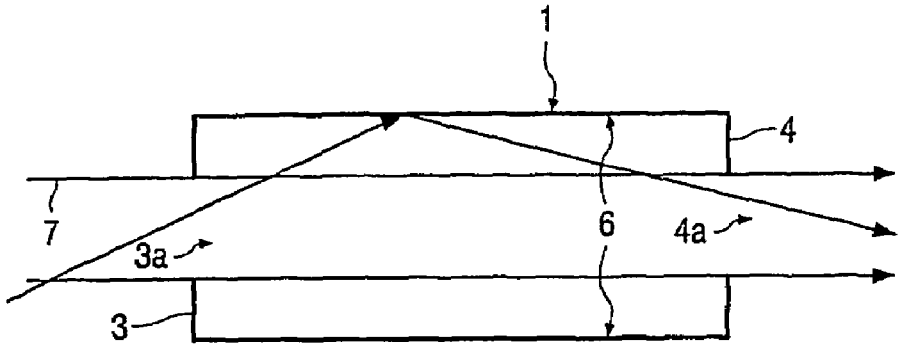

The present patent application is a non-provisional application of International Application No. PCT/IB02/001965, filed May 30, 2002.

The invention relates to an X-ray optical element, a collimator for high-energy electromagnetic radiation, an alternative X-ray optical element, alternative collimator, an X-ray detector as well as a spectrometer.

Notably the detection of X-rays, but also of other high-energy electromagnetic radiation, gives rise to the problem that an examination result concerning information contained in such radiation, for example, spectrometric information or images of regions of different absorption, is falsified by background radiation. It is inevitable, notably in the X-ray range in which X-ray optical elements operate essentially in reflection only and not in transmission, that reflected radiation as produced by the incidence of photos on the reflecting material as well as secondary radiation, such as characteristic radiation of the material used in the relevant optical system, are also detected and hence falsify the result.

In order to reduce scattered radiation, for example, use is made of diaphragms, that is, components which leave only a small opening for the passage of radiation. However, secondary radiation or reflected radiation can also pass through this opening. Such disturbing radiation is reduced when a succession of diaphragms is arranged along the optical path at a distance from one another. However, it is to be noted that secondary radiation is also produced at the area of the opening for the radiation; this is due to the interaction of the radiation with the edge zone of the passage opening, for example, of the diaphragm aperture. This again yields radiation which falsifies a measuring result and is mixed with the measuring signal. The more diaphragms or the like are arranged in succession, the larger the surface area of interaction will be. Therefore, the occurrence of disturbing radiation cannot be effectively counteracted by simply increasing the number of diaphragms.

It is an object of the invention to remove disturbing radiation of the described kind as much as possible from a measuring beam.

This object is achieved in accordance with the invention by means of an X-ray optical diaphragm as disclosed herein, a collimator and an X-ray optical element as well as by means of a collimators, an X-ray detector and a spectrometer. Advantageous embodiments are also disclosed.

Because of the angulation of the edge zone, radiation incident thereon is reflected at an angle which is more inclined, relative to the direction of propagation of the rays, notably X-rays, than in the absence of the angulation. Both the reflected radiation and the secondary radiation are thus removed from the radiation containing the actual information. The disturbance component is thus reduced. However, the construction of the diaphragm overall may still be very thin, thus enabling only slight interaction with the diaphragm material.

The angulation advantageously is such that the passage opening becomes narrower in the beam direction. The rays interacting with the edge zone of the passage opening, therefore, are incident on a surface which is inclined towards the rays in the case of a parallel beam path and hence are very thoroughly deflected away from the propagation direction followed thus far upon incidence on this surface. The risk that deflected rays or secondary rays are also detected, therefore, is small.

It is particularly advantageous, and of a special importance for trace analysis, to arrange several of such diaphragms one behind the other and at a distance from one another, the angulation being particularly advantageous if, in the case of grazing incidence of a light beam along the angulated surface, a first diaphragm does not conduct this light beam to the next diaphragm which is transparent thereto, but against walls of a tube which is arranged between these diaphragms so that beams which are incident on the edge surface at an angle of incidence larger than 0 instead of at a grazing angle are indeed reflected against said walls and not against the next diaphragm. This is important notably for characteristic and hence material-specific X-rays, because the diaphragms are often made of the same material, so that the second diaphragm would be transparent as if it were for such characteristic radiation. A material mix between the diaphragms or similar X-ray optical components would also be of assistance. Such an arrangement with suitably chosen distances between the diaphragms offers a significant improvement of the suppression of the background. The measuring accuracy can thus be significantly increased.

X-ray optical elements of this kind can be used in various devices, notably in collimators in X-ray spectrometers and X-ray detectors for the examination of information originating from an X-ray beam. Trace analysis represents one possible field of application.

An alternative embodiment of an X-ray optical element is provided with a graduation different zones are formed in the direction of propagation of the beam, so that rays which are incident on a wall surface in the elongate zone and are reflected or scattered thereby or cause secondary radiation are kept away from the beam path by reflection or absorption by the step in the subsequent, constricted zone. A collimator may also be provided with such an element; a combination of the abovementioned elements and the graduated elements is also feasible. In any case, an adequate distance should again be maintained between the element at the entrance side and the element at the exit side in the collimator. Elements may also be ranged therebetween.

Figure 2:
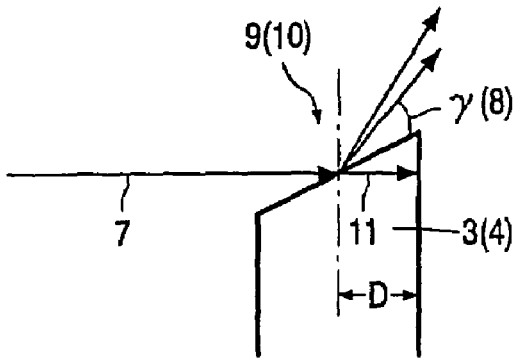
Figure 3:
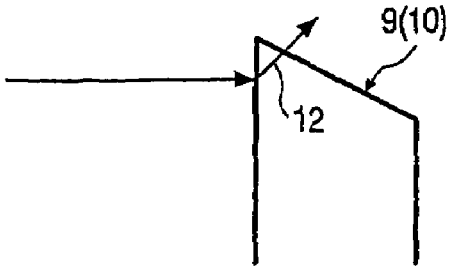
Figure 4:
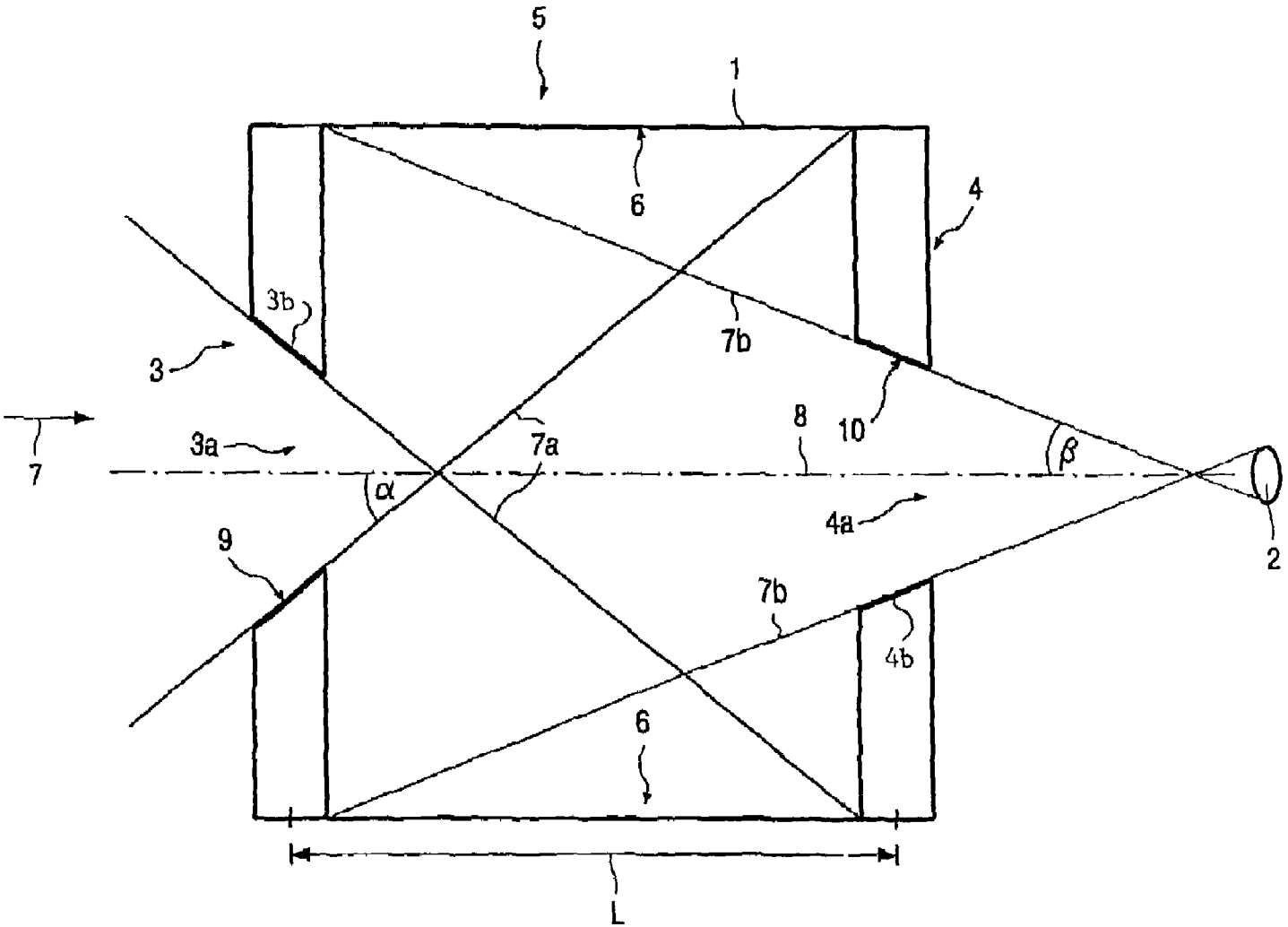
Figure 5:
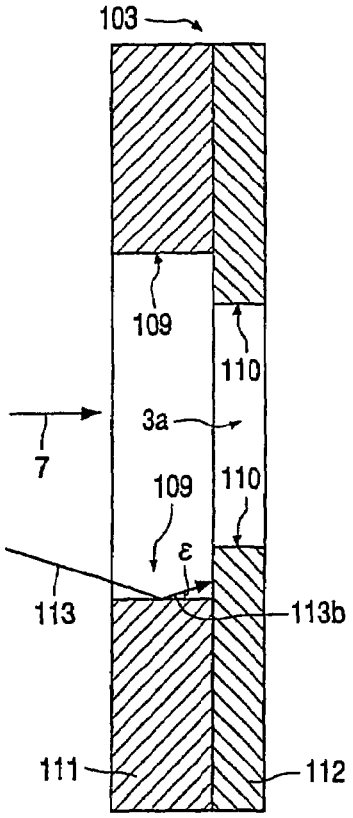
Figure 6:
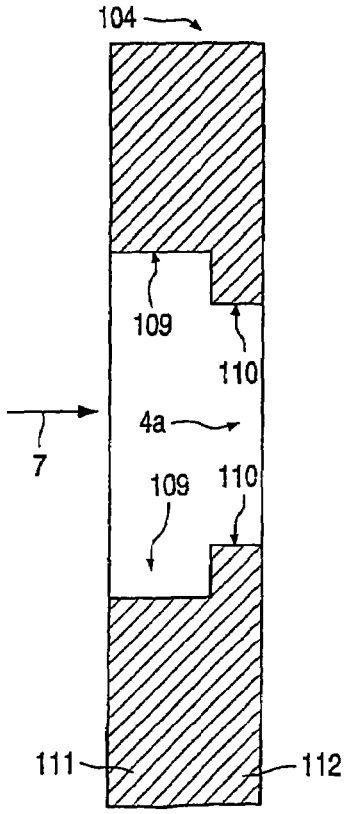

Further advantages and details of the invention will become apparent from the embodiments of the invention which are described with reference to the drawing. In the drawing:

FIG. 1 shows a collimator as part of an X-ray detector or spectrometer with two X-ray optical elements, FIG. 2 is a second view of a first embodiment of an X-ray optical element, FIG. 3 is a cross-sectional view of a second embodiment of an X-ray optical element, FIG. 4 shows a detail at an enlarged scale of the device of FIG. 1 in which X-rays are incident at a grazing angle on the edge zones, FIG. 5 is a cross-sectional view of an alternative embodiment of an X-ray optical element which is composed of two plate members, and FIG. 6 shows an embodiment which is similar to that of FIG. 5 and in which the graduated X-ray optical element is constructed as a single piece.

The collimator 1 shown in FIG. 1 forms part of an X-ray spectrometer (not completely shown) or an X-ray detector in which the X-rays 7 are conducted to a detection surface 2.

The collimator 1 serves as an imaging element which operates purely in the transmission mode for high-energy electromagnetic rays, for example, for X-rays. To this end, the collimator 1 includes an entrance diaphragm 3 and an exit diaphragm 4 as well as a tube 5 which is situated therebetween and on the inner walls 6 of which reflection, scattering or other formation of secondary radiation of the electromagnetic rays propagating along the optical path 8 can take place.

The diaphragms 3, 4 are provided with respective passage openings 3*a*, 4*a* which are constructed, for example, as a slit or as a passage opening bounded by a round contour. The edge zones 3*b*, 4*b* are angulated relative to the direction of propagation of the rays which in this case coincides with the optical axis 8.

The X-ray optical elements 3, 4 may be provided with different angulations in their edge zones 9, 10 as shown in FIG. 3. The angle α of the edge zone 9 of the diaphragm 3 at the entrance side relative to the optical is chosen to be such that a light beam 7*a* which is incident at a grazing angle would not be incident on the diaphragm 4 at the exit side, but on the zones 6 of the walls of the collimator. It is thus ensured that all rays which are not incident at a grazing angle but are reflected at an angle γ relative to the surface of the edge zone 9 will be in on the inner wall zone 6. The same hold for secondary rays emanating at an angle γ. This is of importance notably for characteristic X-rays in which defined, intense peaks arise from the diaphragm material. When the diaphragm 4 at the exit side is mad of the same material as the diaphragm 3 at the entrance side, it will be transparent to such characteristic radiation. Characteristic radiation of this kind would then remain in the beam path without being affected by the diaphragm 4 at the exit side or other diaphragms of the same material. The walls 6, however, are customarily made of a different material, so that absorption of such characteristic radiation can be achieved.

Moreover, the angle β of the edge zones 10 around the passage opening 4*a* of the X-ray optical element 4 at the exit side is such that a grazing ray 7*b* thereon just has to originate from the inner walls 6. The distance L between the entrance diaphragm 3 and the exit diaphragm 4 is chosen accordingly.

In the present construction in the form of hole diaphragms 3, 4, the edge zones 9, 10 are angulated each time on the full circle surrounding the passage zone 3*a*, 4*a*. However, depending on the shape of the passage opening 3*a*, 4*a* for example, in the case of a slit-shaped diaphragm, this is not absolutely necessary. It is not absolutely necessary either that the passage openings 3*a*, 4*a* are constructed in the direction of propagation 7 of the rays as is shown in FIG. 4. The cross-section of the diaphragm opening 3*a* or 4*a* of the diaphragms 3 or 4 is shown in detail in FIG. 2. It appears that a ray 11 penetrates the material of the diaphragm because it enters near the edge zone and hence cannot be completely absorbed by the locally remaining effective diaphragm thickness D. A similar situation occurs in the reverse circumstances as shown in FIG. 3. The shortest 12 shown therein however, will emanate approximately perpendicularly to the angulated surface 9, 10; this path, however, is shorter than the path of the ray 11 in the reverse orientation of the diaphragm. This gives rise to more fluorescence and more scattering which could disturb the measurement.

As opposed to the arrangement shown in FIG. 4, the collimator 1 may also be provided with a total of more than one diaphragm 3 at the entrance side and one diaphragm 4 at the exit side, that is, an arrangement of a plurality of diaphragms may be provided in the beam path 7; in that case each of said diaphragms or some of said diaphragms may be provided with angulated edge zones 9, 10.

The X-ray optical elements 3, 4 together lead to a stronger enlargement of the emission angle γ of scattered radiation and fluorescent radiation, emanating as secondary rays in the case of interaction between hip-energy electromagnetic waves and matter, from the beam path 7 relative to the propagation direction 7 of the rays to be measured on the detector 2. Consequently, fewer of such disturbing rays appear on the detector window 2.

The FIGS. 5 and 6 show X-ray optical elements 103, 104 which can be used as an alternative for the X-ray optical elements 3, 4. A combination of diaphragms 103, 104 and diaphragms 3, 4, for example, within a collimator 1, is also feasible. The diaphragms 3, 4 as well as 103, 104 can be selected and used also in an X-ray detector or spectrometer, as desired.

FIG. 5 shows a diaphragm 103 which is composed of two assembled plate members 111, 112; such plate member 111, 112 may contain materials.

When a diverging ray 113 is incident on the edge zone 109 and is reflected or scattered therefrom or generate secondary rays so that a ray 113*b* is obtained which emanates from the edge surface 109 at the angle ϵ, this ray 113*b* is incident on the constricted zone of the diaphragm 103 or 104. At that area it can either be scattered back or reflected, so that it is removed from the beam path 7. Absorption in the material at the area of the shorter edge zone 110 is also possible. The absorption is particularly effective when the second plate 112 is made of a material other than that of the first plate member 111, because characteristic radiation of the material as produced in the edge zone 109 can then also be absorbed in the plate member 112.

A construction of the diaphragm 104 as a single piece, as shown in FIG. 6, is also possible. Because the effect of the absorption process taking place in the constricted part of the edge zone 110 is comparatively insignificant, such a diaphragm 104, or a diaphragm 103 which comprises two plate members 111, 112 of the same material is also suitable for suppressing scattered or reflected rays or secondary rays in the edge zone 109.

X-ray optical elements 3, 4, 103, 104 of this kind are generally known for use in spectrometers for example for trace analysis, or in X-ray detectors, for example, for the acquisition of information concerning different absorption behaviors of X-rays in a spatially resolved manner. A special application is found in X-ray detectors or spectrometers or spectrometers utilizing similar high-energy radiation.

The invention claimed is:

1. A collimator, for high-energy electromagnetic radiation, comprising a plurality of X-ray optical elements which bound an opening arranged in a beam path including an X-ray optical element at an entrance side and an X-ray optical element at an exit side of the collimator, and a tube having inner walls between the X-ray optical elements at the entrance side and the exit side; wherein the X-ray optical elements are slit or hole diaphragms provided with at least one passage opening for rays; and wherein an edge zone of the X-ray optical element at the entrance side is angled at least partly relative to a direction of propagation of the rays; and the inner walls are of a different material than the diaphragms, wherein at least one of the X-ray optical elements is provided with at least one passage opening for rays, and the edge zone of the X-ray optical element which faces the passage opening is graduated and comprises a zone which is longer in the propagation direction of the rays and has a larger opening and also a subsequent zone in the direction of propagation which is shorter and has a smaller opening.

2. A collimator according to claim 1, wherein the angle of the element at the entrance side is such that a ray which travels at a grazing angle along the angled edge zone of the X-ray optical element at the entrance side is not incident directly on the X-ray optical element at the exit side.

3. A collimator as claimed in claim 1, wherein the X-ray optical elements are arranged at a distance from one another and are provided with respective angulated edge zones.

4. A collimator as claimed in claim 1, wherein the X-ray optical diaphragms enclose the rays in a segment and the collimator is provided on an inner side with walls which reflect or scatter or produce secondary radiation.

5. A collimator as claimed in claim 4, wherein in the collimator there are arranged further diaphragms which bound a beam diameter in order to filter out radiation reflected or scattered by the walls or secondary radiation.

6. A collimator as claimed in claim 1, wherein the X-ray optical diaphragms at the entrance side and the exit side are provided with an angulation of the same orientation.

7. A collimator as claimed in claim 1, wherein an angulation of the element at the exit side is such that a ray which travels at a grazing angle along an angulated edge of the X-ray optical element at the exit side does not originate directly from the X-ray optical element at the entrance side.

8. A collimator as claimed in claim 1 which includes said X-ray optical elements having edge zones at the entrance side and at the exit side.

* * * * *